United States Patent [19]

Howe et al.

[11] Patent Number: 5,009,065

[45] Date of Patent: Apr. 23, 1991

[54] TUNED EXHAUST PROCESSOR ASSEMBLY

[75] Inventors: Michael G. Howe; James C. Arthur; Robert T. Usleman, all of Columbus, Ind.

[73] Assignee: Arvin Industries, Inc., Columbus, Ind.

[21] Appl. No.: 425,308

[22] Filed: Oct. 23, 1989

Related U.S. Application Data

[63] Continuation-in-part of Ser. No. 319,069, Mar. 6, 1989, Pat. No. 4,961,314, which is a continuation-in-part of Ser. No. 232,023, Aug. 15, 1988, abandoned.

[51] Int. Cl.[5] ..... F01N 3/02

[52] U.S. Cl. ..... 60/288; 60/295; 60/311; 55/314; 55/466; 55/DIG. 30

[58] Field of Search ..... 60/288, 311, 295; 55/DIG. 30, 466, 312, 314

[56] References Cited

U.S. PATENT DOCUMENTS

| | | | |
|---|---|---|---|
| 2,947,600 | 8/1960 | Clayton . | |
| 2,956,865 | 10/1960 | Williams . | |
| 3,090,677 | 5/1963 | Scheitlin et al. . | |
| 3,180,712 | 4/1965 | Hamblin | 60/288 |
| 3,445,196 | 5/1969 | Thomas | 60/295 |
| 3,503,714 | 3/1970 | Lang . | |
| 3,712,030 | 1/1973 | Priest . | |
| 3,841,841 | 10/1974 | Torosian et al. . | |
| 4,124,091 | 11/1978 | Mizusawa | 60/311 |
| 4,175,107 | 11/1979 | Iwaoka et al. . | |
| 4,264,344 | 4/1981 | Ludecke et al. . | |
| 4,386,497 | 6/1983 | Takagi et al. . | |
| 4,478,618 | 10/1984 | Bly et al. . | |
| 4,505,106 | 3/1985 | Frankenberg et al. . | |
| 4,512,147 | 4/1985 | Wong . | |
| 4,558,565 | 12/1985 | Kojima et al. . | |
| 4,625,511 | 12/1986 | Scheitlin | 60/299 |
| 4,651,524 | 3/1987 | Brighton . | |
| 4,665,692 | 5/1987 | Inaba . | |

FOREIGN PATENT DOCUMENTS

| | | | |
|---|---|---|---|
| 2247947 | 4/1974 | Fed. Rep. of Germany | 60/288 |

OTHER PUBLICATIONS

MacDonald and Simon: Development of a Particulate Trap System for a Heavy-Duty Diesel Engine Feb. 1988.

Barris and Rocklitz: Development of Automatic Trap Oxidizer Muffler Systems Feb. 1989.

*Primary Examiner*—Douglas Hart

*Attorney, Agent, or Firm*—Barnes & Thornburg

[57] ABSTRACT

An exhaust processor is provided for filtering particulate matter from a combustion product. The exhaust processor includes a partition situated inside a housing to form a first flow passage and a second flow passage in an upstream portion of the housing. A main substrate is mounted in the first flow passage for solid particle filtration. An auxiliary substrate is situated in the second flow passage to filter combustion product passing through the second flow passage during regeneration of the main substrate. A muffler is situated in a downstream portion of the housing and is arranged so that the entire spacial volume of the muffler can be utilized by combustion product passing through either the first or second flow passages.

30 Claims, 6 Drawing Sheets

TUNED EXHAUST PROCESSOR ASSEMBLY

BACKGROUND AND SUMMARY OF THE INVENTION

This application is a continuation-in-part of copending application Ser. No. 07/319,069 filed Mar. 6, 1989 now U.S. Pat. No. 4,961,314 which is a continuation-in-part of Ser. No. 07/232,023 filed Aug. 15, 1988, and now abandoned.

This invention relates to exhaust processors for filtering particulate matter from a combustion product, and particularly to an exhaust processor having a by-passable filter regeneration system. More particularly, the present invention relates to an exhaust processor assembly having a main substrate situated in a first flow passage inside a processor housing, an auxiliary substrate situated in a second flow passage inside the housing, and a muffler situated in a downstream portion of the housing in close proximity to an outlet of the exhaust processor assembly.

It is well known in the art to employ a diesel particulate trap which filters combustion product from an engine by passing the combustion product through a filter element or substrate to remove solid particles and pollutants before the combustion product is released to the atmosphere. These substrates must periodically be cleaned to restore functionality to the trap. Heat is applied to each substrate to burn and oxidize trapped carbon particles removed from the combustion product in the substrate. During this cleansing or "regeneration" it is advantageous to divert the combustion product through an auxiliary passageway bypassing the substrate to allow regeneration of the substrate by a burner or heat source.

One object of the present invention is to incorporate a muffler into an exhaust processor assembly to meet acceptable noise standards by attenuating exhaust noise and also to provide an obstacle to easy disablement of an exhaust filter in the assembly by tampering with the exhaust filter while leaving the muffler in a functioning state.

Another object of the present invention is to provide muffler means, situated in a flow passage bypassing an exhaust filter, for attenuating noise produced by the exhaust as it is diverted through the bypass flow passage during regeneration of the filter.

Yet another object of the present invention is to provide a single housing including means for treating a combustion product and means for attenuating noise from the combustion product during regeneration of the treating means.

Still another object of the invention is to house an exhaust filter, substrate, or other combustion product treatment means in one flow passage of an exhaust process or assembly and an acoustic muffling device or other noise attenuation means in a second flow passage of the exhaust process or assembly.

A further object of the invention is to divide an upstream portion of an exhaust processor housing into a first flow passage containing a substrate and a second flow passage bypassing the substrate and place a muffler in a downstream portion of the housing to receive combustion product from both of the first and second flow passages before the combustion product is discharged from the housing so that noise of combustion product conducted through either a main or substrate bypass passage is attenuated by a muffler in the housing.

A still further object of the invention is to provide a mixing region between a partition which cooperates with an inner wall of the housing to define first and second flow passages in the upstream portion of the housing and a muffler situated in the downstream portion of the housing to permit combustion product passing through the first and second flow passages to mix prior to entering the muffler so that the entire spatial volume of the muffler can be utilized by combustion product passing through either the first or second flow passage.

An additional object of the present invention is to provide a substrate for filtering combustion product in an internal flow passage spaced apart from the wall of the housing so that combustion product from an engine flows evenly around the substrate to reduce thermal stresses in the substrate, thereby reducing the risk of failure of the substrate.

Another object of the present invention is to provide a main substrate situated in a first flow passage of an exhaust processor and an auxiliary substrate situated in a second flow passage so that all combustion product passing through the housing is conducted through one of the two flow passages so that it is treated or filtered to prevent untreated combustion products from being discharged into the environment.

According to the present invention, an exhaust processor assembly includes a housing having an inlet for introducing combustion product into the housing and an outlet for discharging the combustion product from the housing. A partition is positioned within the housing for dividing an upstream portion of the housing into first and second flow passages. A muffler is situated in a downstream portion of the housing in close proximity to the outlet to attenuate noise generated by combustion product passing through one of the first and second flow passages toward the outlet.

A main substrate is situated in the first flow passage to lie intermediate the inlet and the muffler. The main substrate is configured to collect particulate matter entrained in combustion product introduced into the first flow passage through the inlet. An auxiliary substrate is situated in the second flow passage and is configured to collect particulate matter entrained in the combustion product introduced into the second flow passage through the inlet.

In preferred embodiments, a top shell and a complementary bottom shell are joined together to form the housing. The partition includes an outer flange trapped between portions of the top and bottom shells to secure the partition in its position within the housing. The partition and the bottom shell cooperate to define the first flow passage for housing the main substrate, and the partition and the top shell cooperate to define the second flow passage for bypassing the substrate during regeneration of the main substrate.

The muffler extends between the top and bottom shells to provide means for reversing the direction of combustion flow to attenuate noise generated by the combustion product passing through the housing. The reversing means includes a plurality of baffles interconnecting the top shell and the bottom shell to define a plurality of chambers. At least two tubes are configured to interconnect selected chambers to define means for conducting combustion products through the muffler toward the outlet.

In one preferred embodiment, the auxiliary substrate is positioned in the second flow passage to lie intermediate the inlet and the muffler in a spaced apart relation to the muffler. In another preferred embodiment, the auxiliary substrate is positioned to extend into the muffler and includes an inlet end communicating with the second flow passage and an outlet end emptying into the muffler.

One feature of the present invention is the provision of a muffler situated in a downstream portion of a housing and a partition which divides an upstream portion of the housing into first and second flow passages. The first flow passage contains a main substrate for solid particle filtration of combustion products, and the second flow passage contains an auxiliary substrate for solid particle filtration of the combustion products passing through the second flow passage during regeneration of the main substrate. Advantageously, such a feature causes combustion products passing through the housing to be conducted through either the first or second flow passage to be treated by the main substrate or the auxiliary substrate, respectively. Therefore, no untreated combustion products will exit the exhaust processor through the outlet.

In this specification and in the claims, the words "an exhaust processor" are intended to refer to various types of catalytic converters and processors, diesel particulate filters, and other particulate traps in connection with which the invention may be used.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
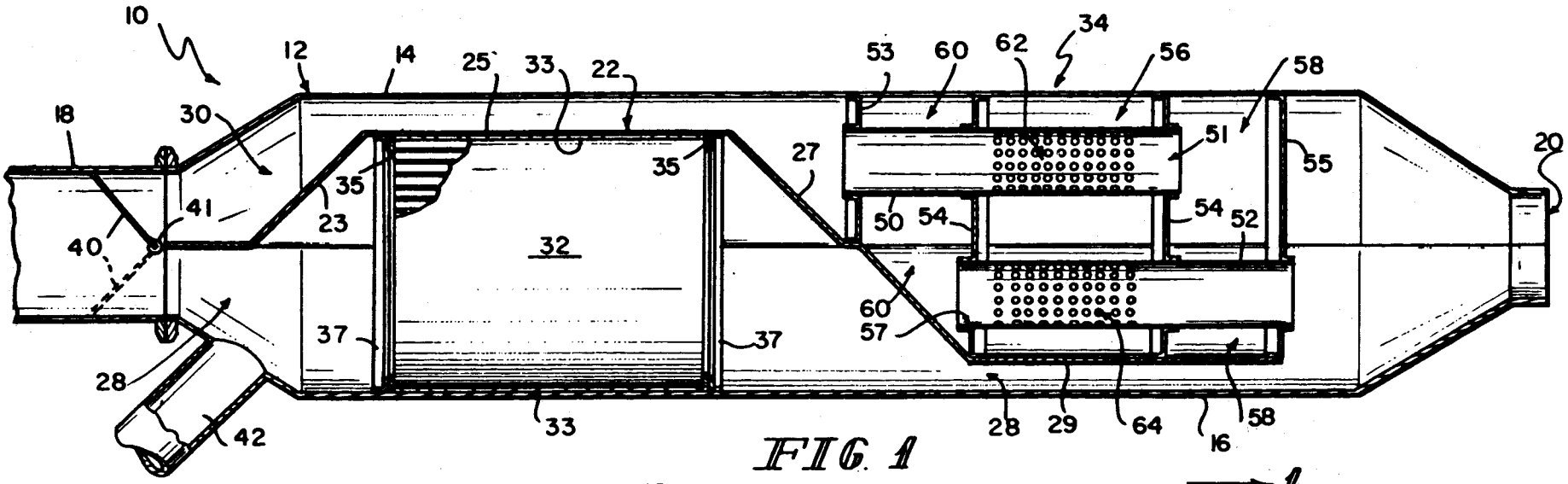
FIG. 1 is a sectional view of an exhaust processor, taken along lines 1—1 of FIG. 3, with portions broken away, incorporating one of the preferred embodiments of the present invention.

Exhaust exits an engine or any other means (not shown) which produces a combustion product containing noxious pollutants or solid particles. The exhaust is passed from the engine (not shown) to the inlet of an exhaust processor assembly 10, 210, 310, 410, or 510 through an inlet pipe 18 or other suitable means. Each of these assemblies 10, 210, 310, 410, or 510 comprise one of the preferred embodiments of the present invention.

An exhaust processor assembly 10 of the present invention includes a housing 12 of the clamshell type including a top or upper half shell 14 and a bottom or lower half shell 16. The housing 12 further includes an inlet 18 to receive combustion product from an engine (not shown), and an outlet 20 for exhausting combustion product from the housing 12. A partition 22 is located inside the housing 12 to define a first region or first flow passage 28 and a second region or second flow passage 30 inside the housing. The partition 22 is a three dimensional, thin-walled, sheet metal stamping and is constructed to include an inlet cone section 23, a first body section 25, a transition section 27, and a second body section 29.

Figure 3:
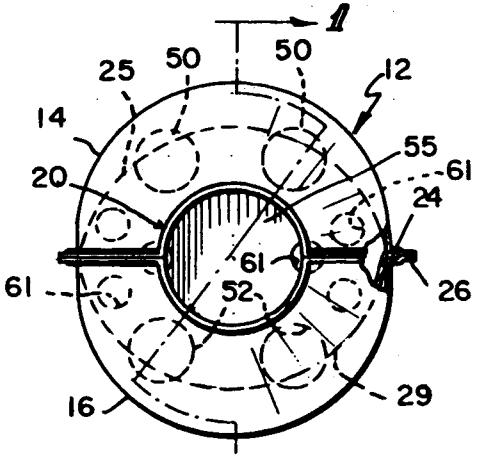
FIG. 3 is an end elevational view of the exhaust processor shown in FIG. 1 taken at the outlet end of the exhaust processor.
Figure 2:
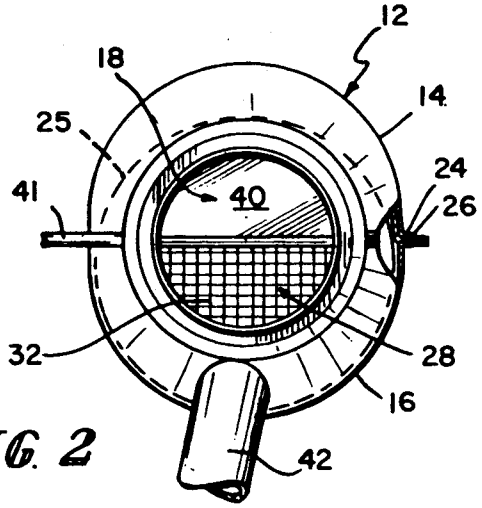
FIG. 2 is an end elevational view of the exhaust processor shown in FIG. 1 taken at the inlet end of the exhaust processor.

The partition 22 is secured inside the housing 12 to divide the interior region of assembly 10 into the flow passages 28 and 30. As best shown in FIGS. 2 and 3, peripheral flange 24 of partition 22 is trapped between the outer flanges 26 of the upper half shell 14 and lower half shell 16 to secure the partition 22 in a proper position inside housing 12.

A substrate 32 is positioned in the first flow passage 28 in close proximity to inlet 18. The substrate 32 is illustratively a cylindrically shaped monolithic cellular structure of conventional diameter and length. Of course, substrate 32 could be any suitable shape. The substrate is supported in its proper position by any conventional support means such as mat 33. End seals 35 provide a seal between the substrate 32 and the wall of first flow passage 28. Retaining rings 37 hold substrate 32, mat 33, and end seals 35 in proper positions within the first flow passage 28. This arrangement insures that all the combustion product entering the first flow passage 28 will pass through substrate 32 by creating an impenetrable seal between the substrate 32 and an inner wall of first flow passage 28.

A muffler subassembly 34 is positioned in the second flow passage 30 of housing 12 in close proximity to the outlet 20 of housing 12. The muffler subassembly 34 acoustically tunes combustion product passing through the second flow passage 30 during regeneration of the substrate 32.

In the embodiment shown in FIG. 1, a bypass valve 40 pivotally coupled to housing 12 at location 41 directs flow of combustion product from the engine (not shown) into either the first flow passage 28 or the second flow passage 30 of housing 12. During normal operation, valve 40 is situated in a first valve position as shown in FIG. 1 to direct flow of the combustion product through the first flow passage 28 and into substrate 32 to treat the combustion product. As the combustion product exits substrate 32, it continues to move through the first flow passage 28 and is exhausted from the housing 12 through outlet 20. The substrate 32 removes solid particles and other pollutants from the combustion product.

Backpressure contribution of the substrate 32 increases significantly once the substrate is clogged and saturated with solid particles entrained in the combustion product. Therefore, the substrate 32 must periodically be cleaned to restore its functionality. To clean substrate 32, heat is applied to the substrate 32 by activating a burner (not shown) through burner inlet 42 to burn and oxidize trapped carbon particles, thereby regenerating substrate 32.

During regeneration of substrate 32 it is advantageous to divert incoming combustion product away from substrate 32 to enhance particle burning and oxidizing activity in the substrate 32. The valve 40 is moved to a second valve position (dotted position shown in FIG. 1) by control means (not shown) to direct flow of the combustion product into the second flow passage 30 of the housing 12 before regeneration of substrate 32 begins and after the backpressure increase of the substrate 32. The combustion product therefore bypasses the substrate 32 and passes through muffler subassembly 34 located in the second flow passage 30 of housing 12. Once regeneration of substrate 32 is complete, the valve 40 is returned to the first valve position to direct the combustion product emitted from the engine into first flow passage 28 and into substrate 32 for treatment therein.

Muffler subassembly 34 includes inlet tubes 50 and outlet tubes 52. A plurality of baffles 53, 54, and 55 are used to secure the inlet tubes 50 and outlet tubes 52 inside the second flow passage 30 between the partition 22 and the housing 12. The configuration and orientation of inlet tubes 50 and outlet tubes 52 inside the housing 12 is illustrated in FIGS. 1 and 3.

The baffles 53, 54, and 55 are configured and positioned to define an expansion chamber 56, a first resonator chamber 58, and a second resonator chamber 60. Upstream baffle 54 includes at least one aperture means 61 for allowing a flow of combustion product to reach chamber 60. Combustion product enters the muffler subassembly 34 through inlet tubes 50 and is conducted into expansion chamber 56 via inlet tubes 50 and apertures 62 formed therein without communicating with combustion product in second resonator chamber 60. The combustion product then travels through a central region of chamber 56 and enters outlet tubes 52 through apertures 64. It then flows through outlet tubes 52 without communicating with combustion product in first resonator chamber 58 and is exhausted through outlet 20 of housing 12. Some of the combustion product enters either the first resonator chamber 58 through openings 51 of tubes 50 or the second resonator chamber 60 either through opening 57 of tubes 52 or flow through holes 61 in baffles 54. These holes 61 are provided in each baffle 54 to allow flow from chamber 58 to chamber 60 through chamber 56 on its way to outlet 20 through exit tubes 52. The resonator chambers 58 and 60 further attenuate the low frequency components of the combustion product.

Figure 4:
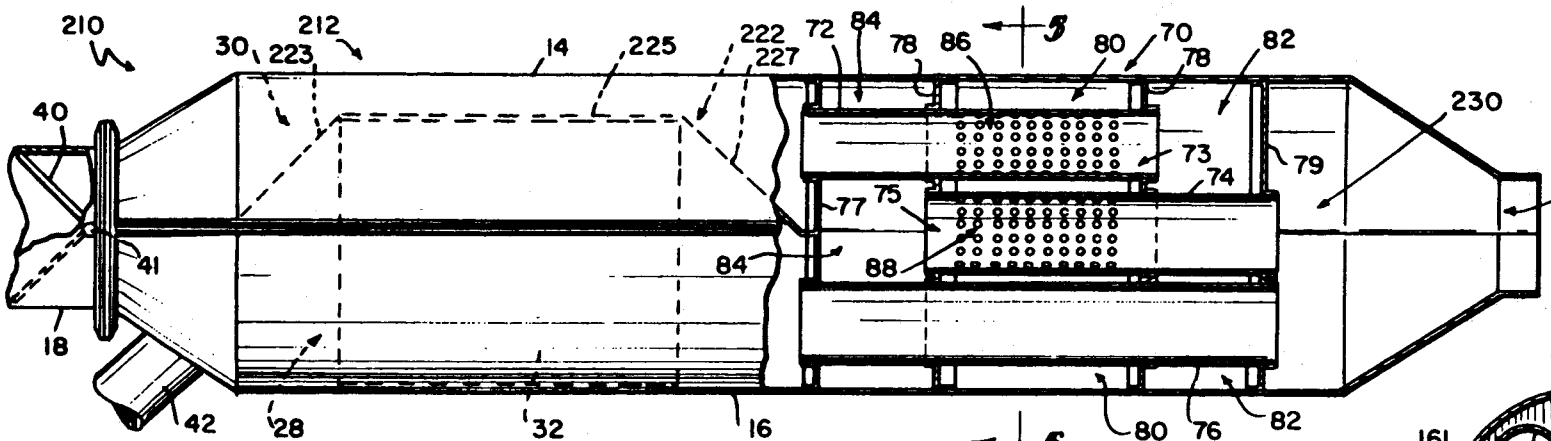
FIG. 4 is a side elevational view of a second embodiment of the present invention, with portions broken away to reveal detail of the muffler.
Figure 5:
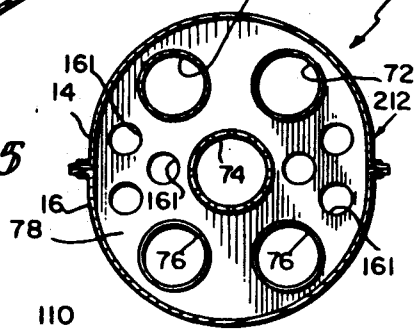
FIG. 5 is a transverse cross-sectional of the exhaust processor assembly shown in FIG. 4, taken along lines 5—5 of FIG. 4.

Another embodiment of the invention is illustrated in FIGS. 4 and 5. Those elements referenced by numbers identical to those in FIGS. 1-3 perform the same or similar function. In the embodiment of FIGS. 4 and 5, the valve 40 operates in the manner discussed above with regard to the embodiment of FIGS. 1-3. During normal operation, the valve 40 directs combustion product entering housing 212 of exhaust processor assembly 210 through the inlet 18 into the first flow passage 28 so that the combustion product from the engine (not shown) passes through substrate 32. When the filter becomes clogged and saturated with solid particles removed from the combustion product, the valve 40 moves to the second valve position, shown in dotted lines in FIG. 4 so that the combustion produot is diverted into the second flow passage 30 to bypass substrate 32.

A partition 222 is mounted in housing 212 to divide the interior region of housing 212 adjacent to inlet 18 into first and second flow passages 28 and 30. This partition 222 is shorter in length than the partition 22 illustrated in connection with the embodiment of FIGS. 1-3. Partition 222 includes an inlet cone section 223, a body section 225, and an outlet cone section 227 abutting baffle 77 as shown in FIG. 4.

In the embodiment of FIGS. 4 and 5, the upper shell 14 and lower shell 16 cooperate to define a third flow passage 230 interconnecting the first and second flow passages 28 and 30 and the housing outlet 20. The muffler subassembly 70 extends across the third flow passage 230. As shown best in FIG. 5, muffler subassembly 70 includes dual inlet tubes 72 and an outlet tube 74. In addition, dual unperforated solid vent tubes 76 provide a pair of outlet flow channels to permit combustion product to pass from the substrate 32 through muffler subassembly 70 to the outlet 20 so that the treated combustion product can be exhausted from the housing.

A plurality of baffles 77, 78, and 79 are mounted within housing 212 to secure inlet tubes 72, outlet tube 74, and vent tubes 76 in the predetermined orientation shown in FIG. 5 inside the housing 212 between upper and lower half shells 14 and 16. As shown in FIG. 5, outlet tube 74 is located in substantially the center of housing 212. Dual inlet tubes 72 are situated above the outlet tube 74 and dual vent tubes 76 are situated below outlet tube 74.

The baffles 77, 78, and 79 are configured and located to define an expansion chamber 80, a first resonator chamber 82, and a second resonator chamber 84. The combustion product enters the muffler subassembly 70 and is conducted into expansion chamber 80 via dual inlet tubes 72 and apertures 86 formed therein without communicating with combustion product extant in second resonator chamber 84. The combustion product then enters outlet tube 74 through apertures 88 and is exhausted from the housing through outlet 20. Although the outlet end of tube 74 extends through second resonator chamber 82, the combustion product traveling through tube 74 is not discharged into chamber 82. A portion of the combustion product conducted through second flow passage 30 is discharged into either first resonator chamber 82 through openings 73 in tubes 72 or into second resonator chamber 84 through openings 75 of tube 74. Combustion product can pass from chamber 82 into chamber 84 through chamber 80 via holes 161 formed in baffles 78. Resonator chambers 82 and 84 further attenuate the low frequency components of the combustion product.

In this embodiment, the volume of the muffler subassembly 70 (i.e. chambers 80, 82, and 84) is increased in comparison to the embodiment of FIGS. 1–3 because of the expansion of the space available for muffler 70 between shells 14 and 16 resulting from the shorter length of partition 222 compared to partition 22. Therefore, greater sound attenuation is achieved in the embodiment illustrated in FIGS. 4–5.

Figure 6:
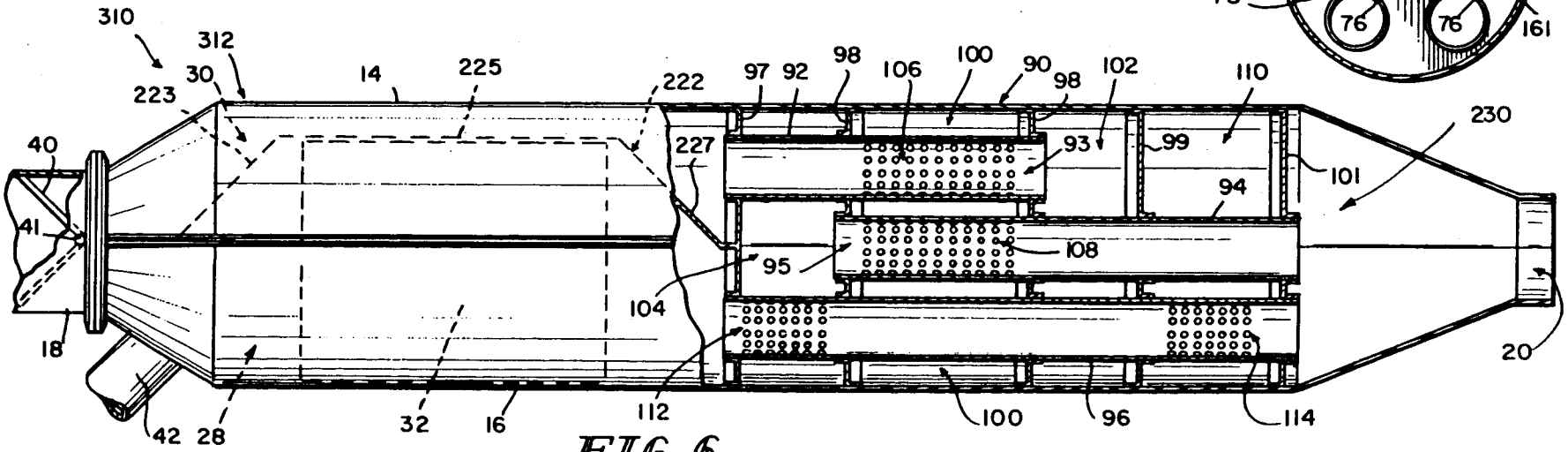
FIG. 6 is a side elevational view of a third embodiment of the present invention, with portions broken away to reveal another configuration of a muffler.

Yet another embodiment of the present invention is illustrated in FIG. 6. Those elements referenced by numbers identical to those used in FIGS. 1–5 perform the same or similar function. In this embodiment, exhaust processor assembly 310 includes a lengthened housing 312 to accommodate an additional resonator chamber in the muffler subassembly.

Muffler subassembly 90 inside housing 312 includes dual inlet tubes 92 arranged in a manner similar to that of tubes 72 in FIG. 5 and a single outlet tube 94. Dual vent tubes 96 are likewise arranged in a manner similar to that of tubes 76 in FIG. 5 and permit combustion product exiting substrate 32 to be exhausted from the housing 12 through outlet 20. A plurality of baffles 97, 98, 99, and 101 are used to secure the inlet tubes 92, outlet tube 94, and vent tubes 96 in a predetermined orientation inside the housing 312 between upper and lower half shells 14 and 16. The baffles 97, 98, 99, and 101 are configured and located to define an expansion chamber 100, a first resonator chamber 102, a second resonator chamber 104, and a third resonator chamber 110.

During regeneration of the substrate 32, the combustion product is diverted by valve 40 through second flow passage 30 and enters the muffler 90 through dual inlet tubes 92. The combustion product is conducted into expansion chamber 100 via inlet tubes 92 and the apertures 106 formed therein without communicating with combustion product extant in second resonator chamber 104. The combustion product then enters outlet tube 94 via apertures 108 and is exhausted from the housing 312 through outlet 20. A portion of the combustion product passes the apertures 106 in inlet tubes 92 and enters resonator chamber 102 through opening 93 in tubes 92, and another portion of the combustion product enters resonator chamber 104 through opening 95 in outlet tube 94. Combustion product can pass from chamber 110 into chamber 104 through chamber 102 via holes (not shown) in baffles 98. These holes are similar to holes 161 shown in FIG. 5. The resonator chambers 102 and 104 further attenuate the low frequency components of the combustion product.

Muffler subassembly 90 is also formed to include a third resonator chamber 110. The dual vent tubes 96 are perforated to include a first set of apertures 112 in close proximity to substrate 32 and a second set of apertures 114 in close proximity to outlet 20. A portion of the combustion product exiting substrate 32 and passing through vent tubes 96 enters the second resonator chamber 104 through the first set of apertures 112. In addition, another portion of the combustion product flowing through vent tubes 96 enters the third resonator chamber 110 through the second set of apertures 114. This design also increases the volume of the muffler subassembly 90 for sound attenuation. In this embodiment, reversing the flow of combustion product through the first and second sets of apertures 112 and 114 is possible to utilize the volume in the muffler subassembly 90 to attenuate sound of the exhaust exiting the substrate 32.

Figure 7:
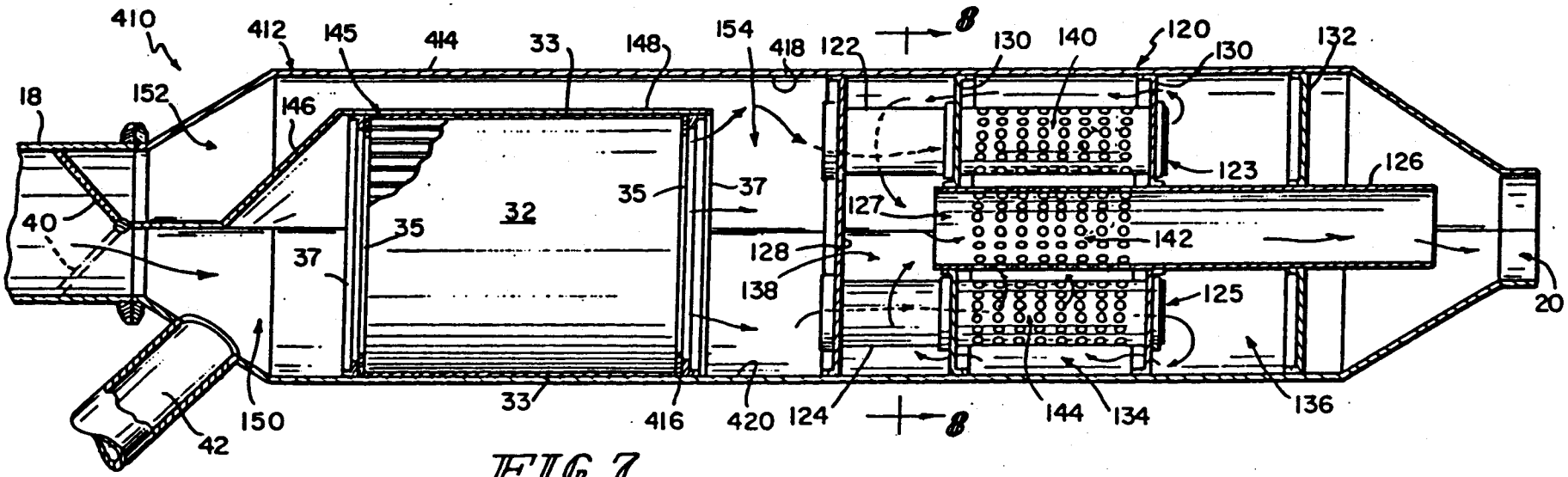
FIG. 7 is a sectional view of a fourth embodiment of the present invention showing a mixing region in between an upstream filter and bypass assembly and a downstream muffler assembly, the view being taken along lines 7—7 of FIG. 8, with portions broken away.
Figure 8:
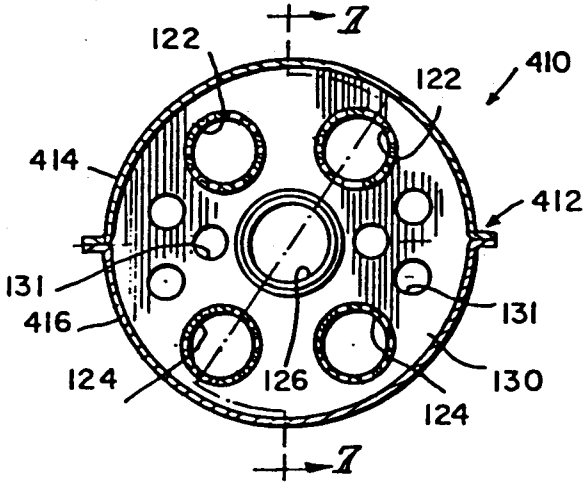
FIG. 8 is a transverse cross-sectional view of the exhaust processor assembly shown in FIG. 7, taken along lines 8—8 of FIG. 7.

Still another embodiment of the present invention is illustrated in FIGS. 7–8. Those elements referenced by numbers identical to those used in FIGS. 1–6 perform the same or similar function. In this embodiment, exhaust processor assembly 410 includes a housing 412 having a muffler subassembly 120 situated in close proximity to the outlet 20. A partition 145 is spaced apart from muffler subassembly 120 and divides an upstream portion of the housing 412 in close proximity to inlet 18 into a first region 150 having a substrate 32 located therein and a second region 152.

Muffler subassembly 120 inside housing 412 includes an upper set of dual inlet tubes 122 located in close proximity to top half shell 414 and a lower set of dual inlet tubes 124 located in close proximity to bottom half shell 416. A single outlet tube 126 permits combustion product entering the muffler subassembly 120 to be exhausted through outlet 20. FIG. 8 illustrates the cross-sectional arrangement of the tubes 122, 124, 126 inside housing 412.

A plurality of baffles 128, 130, and 132 are used to secure the upper inlet tubes 122, the lower inlet tubes 124, and outlet tube 126 in a predetermined orientation inside the housing 412 between top and bottom half shells 414 and 416. The baffles 128, 130, and 132 are configured and located to define an expansion chamber 134, a first resonator chamber 136, and a second resonator chamber 138.

A partition 145 is mounted in housing 412 to extend along the longitudinal axis of housing 412 and divide an upstream portion of housing 412 in close proximity to inlet 18 into a first region 150 and a second region 152. Partition 145 includes an inlet cone section 146 and a body section 148. A downstream end of partition 145 is axially spaced apart from baffle 128 to form a mixing region 154 between the downstream end of partition 145 and the upstream end of muffler 120 as shown in FIG. 7.

A substrate 32 is situated in the first region 150 and extends radially between the partition 145 and bottom shell 416 to intercept and treat all combustion product flowing downstream through first region 150. During normal operation, valve 40 is situated in its solid line position shown in FIG. 7 to direct flow of the combustion product through the first region 150 and into substrate 32.

During regeneration of the substrate 32, combustion product entering housing 412 through inlet 18 is diverted by valve 40 into the second region 152. Combustion product exiting from either first region 150 or second region 152 is discharged into mixing region 154 located between the substrate 32 and muffler subassembly 120. In the illustrated embodiment, mixing region 154 is a substantially cylindrically shaped space bounded at its upstream end by the outlet face of substrate 32 and at its downstream end by baffle 128. Interior surfaces 418, 420 of shells 414 and 416, respectively, cooperate to define the side boundary of mixing region 154. Combustion product discharged into mixing region 154 is able to enter muffler subassembly 120 through any of inlet tubes 122, 124. Therefore, combustion product discharged through either substrate passage 150 or bypass passage 152 is exposed to the same muffler system 120.

Any combustion product discharged from substrate 32 during regeneration is free to mix with the combustion product diverted through bypass passage 152 so that the mixture is conducted into muffler subassembly 120. Once the combustion product enters the muffler subassembly 120, it is conducted into expansion chamber 134 via inlet tubes 122 and 124 and the apertures 140 and 144 respectively, formed therein without communicating with combustion product extant in second resonator chamber 138. The combustion product then enters outlet tube 126 via apertures 142 and is exhausted from the housing 412 through outlet 20. A portion of the combustion product passes the apertures 140 in inlet tubes 122 and enters resonator chamber 136 through openings 123 in upper inlet tubes 122, and another portion of the combustion product enters resonator chamber 136 through openings 125 in lower inlet tubes 124.

An additional portion of the combustion product enters resonator chamber 138 through opening 127 in outlet tube 126. Combustion product can pass from resonator chamber 136 into resonator chamber 138 through expansion chamber 134 via holes 131 in baffles 130 as shown in FIG. 8. The resonator chambers 136 and 138 further attenuate low frequency components of the combustion product.

Figure 9:
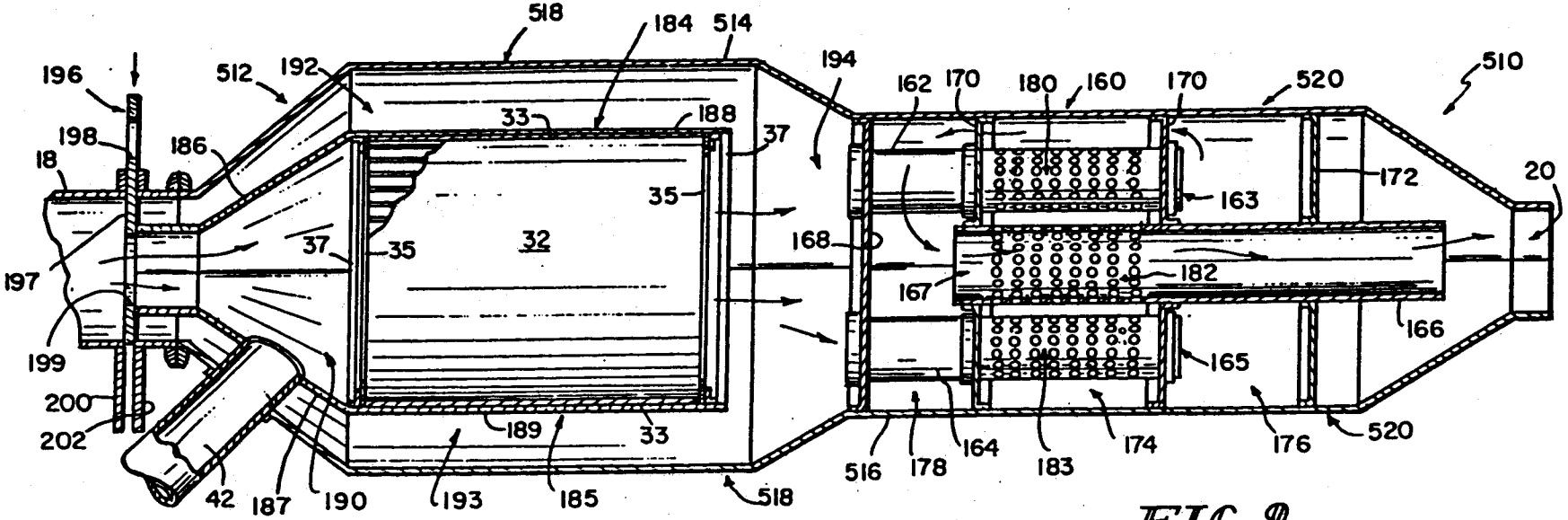
FIG. 9 is a sectional view of a fifth embodiment of the present invention, with portions broken away, showing a mixing region in between an upstream filter and bypass assembly and a downstream muffler assembly and illustrating a bypass-closing position of a bypass valve at the housing inlet.
Figure 10:
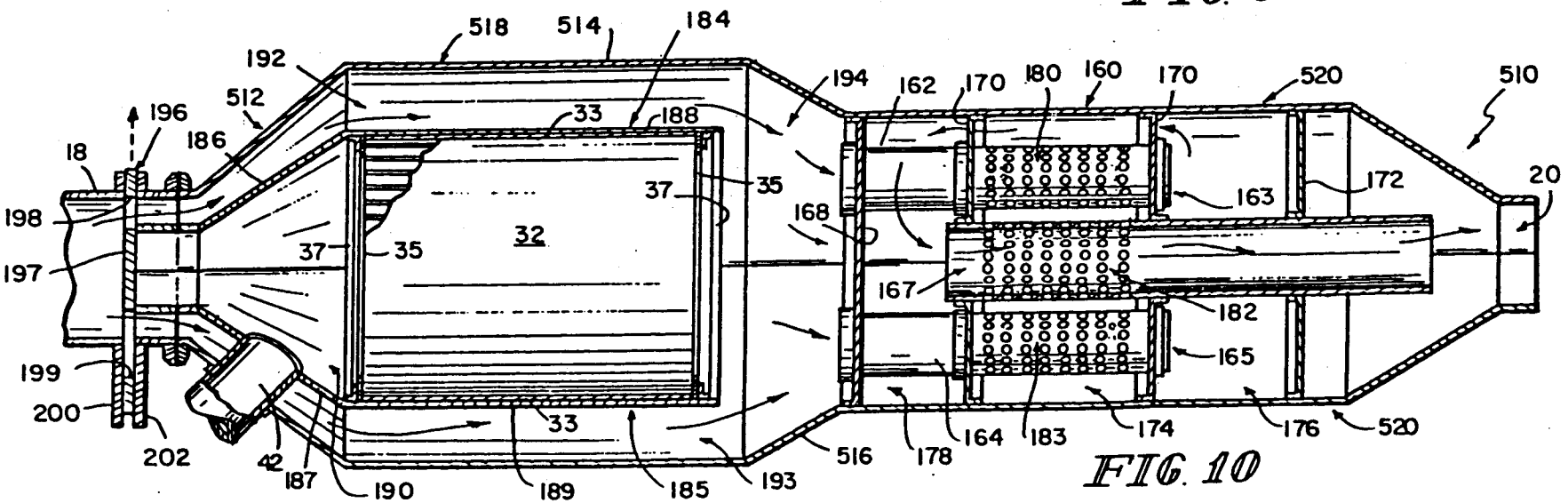
FIG. 10 is a sectional view of the embodiment shown in FIG. 9, with portions broken away, illustrating a bypass-opening position of the bypass valve.

A further embodiment of the present invention is illustrated in FIGS. 9–10. Those numbers referenced by numbers identical to those used in FIGS. 1–8 perform the same or similar function. In this embodiment, exhaust processor assembly 510 includes a housing 512 having a top shell 514 and a bottom shell 516 which cooperate to define a main flow passage through housing 512. A first upstream portion 518 of housing 512 located in close proximity to inlet 18 has a diameter larger than the diameter of a second downstream portion 520 of the housing 512 located in close proximity to the outlet 20.

A muffler subassembly 160 is located in the second downstream portion 520 of housing 512. Muffler subassembly 160 includes an upper set of inlet tubes 162 located in close proximity to top shell 514, and a lower set of inlet tubes 164 located in close proximity to bottom shell 516. A single outlet tube 166 permits combustion product to be exhausted from the housing 512 through outlet 20. Inlet tubes 162, outlet tube 166, and inlet tubes 164 are arranged in a manner similar to inlet tubes 122, outlet tube 126, and inlet tubes 124 shown in FIG. 8.

A plurality of baffles 168, 170, and 172 are used to secure upper inlet tubes 162, outlet tube 166 and lower inlet tubes 164 in a predetermined orientation inside the housing 512 between top and bottom shells 514 and 516. The baffles 168, 170, and 172 are configured and located to define an expansion chamber 174, a first resonator chamber 176, and a second resonator chamber 178.

An upper internal shell or partition member 184 and a lower internal shell or partition member 185 are located in the first portion 518 of housing 512 in close proximity to inlet 18. Upper and lower partition members 184, 185 include a flange (not shown) which is trapped between portions of the top and bottom shells 514 and 516 to position the partition members 184, 185 within the housing 512. Upper partition member 184 includes an inlet cone section 186 and a body section 188, and lower partition member 185 includes an inlet cone section 187 and a body section 189. Upper and lower partition members 184, 185 cooperate to define a first region 190 inside housing 512. The first region 190 provides an internal flow passage through a portion of a main flow passage defined by the inner walls of top and bottom shells 514 and 516. A substrate 32 extends between upper partition member 184 and lower partition member 185 to remove particulate matter from combustion product directed through the first region of the housing by valve 196 as shown in FIG. 9. It will be understood that any suitable means for mounting the substrate 32 inside housing 512 can be used in place of partition members 184, 185.

Valve 196 is slideably movable between a first bypass-closing position and a second bypass-opening position. In the first position (shown in FIG. 9), valve 196 directs flow of combustion product entering housing 512 through inlet 18 into the first region 190 containing substrate 32. In the second position (shown in FIG. 10), valve 196 directs flow of combustion product into the first and second bypass channels 192, 193. The valve includes a shuttle plate 197 trapped between first retainer 200 and second retainer 202. The retainers are in communication with inlet 18 as shown in FIGS. 9 and 10. Shuttle plate 197 is formed to include apertures 198 and 199 to direct flow of combustion product into either the first region 190 or alternatively into the first and second bypass channels 192, 193.

During regeneration of substrate 32, valve 196 is positioned in the second position as shown in FIG. 10 so that combustion product is diverted into first and second bypass channels 192 and 193. Top shell 514 and upper partition member 184 cooperate to define the first bypass channel 192, and bottom shell 516 and lower partition 185 cooperate to define the second bypass channel 193.

Because upper and lower partition members 184, 185 are spaced apart from the wall of the housing 512, the outer surface of substrate 32 is heated by combustion product flowing through the bypass channels 192, 193 to a substantially uniform temperature. This configuration reduces hot spots caused by uneven heating of the substrate 32, thereby reducing the risk of cracking the substrate.

Upper and lower partition members 184, 185 are spaced apart from baffle 168 to form a mixing region 194 between the substrate 32 and the muffler subassembly 160. Combustion product flowing through first region 190 and combustion product flowing through first and second bypass channels 192, 193 mixes in mixing region 194 prior to entering muffler subassembly 160. The mixture of combustion product can enter any of the upper set of inlet tubes 162 or the lower set of inlet tubes 164. Therefore, the entire volume of the muffler is utilized by combustion product flowing through either the first region 190 or the first and second bypass channels 192, 193.

Combustion product from mixing region 194 is conducted into expansion chamber 174 via inlet tubes 162 and 164 and the apertures 180 and 183, respectively, formed therein without communicating with combustion product extant in second resonator chamber 178. The combustion product then enters outlet tube 166 via apertures 182 and is exhausted from the housing 512 through outlet 20. A portion of the combustion product passes the apertures 180 in inlet tubes 162 and enters resonator chamber 176 through openings 163 in upper inlet tubes 162, and another portion of the combustion product enters resonator chamber 176 through openings 165 in lower inlet tubes 164.

An additional portion of the combustion product enters resonator chamber 178 through opening 167 in outlet tube 166. Combustion product can pass from resonator chamber 176 into resonator chamber 178 through expansion chamber 174 via holes (not shown) in baffles 170. The holes formed in baffles 170 are similar to the holes 131 in baffle 130 as shown in FIG. 8. The resonator chambers 176 and 178 further attenuate low frequency components of the combustion product.

An advantage of both the embodiment shown in FIG. 7 and the embodiment shown in FIGS. 9–10 is that the configuration of the mixing regions 154 and 194, respectively, allow for additional volume at the outlet of both the bypass flow and the substrate flow. This would contribute to sound attenuation when the processor is operating in either mode. A second advantage of the construction shown in FIGS. 7–10 is that the total muffler section 120 or 160 is available for sound attenuation in either the substrate or bypass mode.

Figure 11:
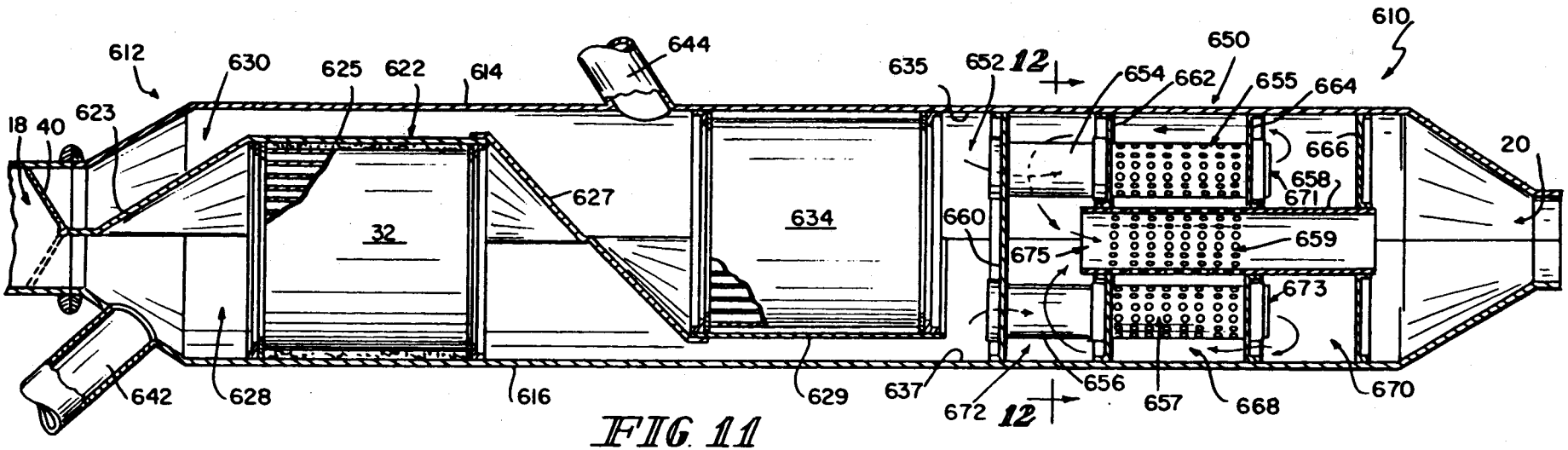
FIG. 11 is a sectional view of a sixth embodiment of the present invention, with portions broken away, showing a main substrate situated in a first flow passage, an auxiliary substrate situated in a second flow passage, and a muffler assembly situated inside the housing between the first and second flow passages and the housing outlet.
Figure 12:
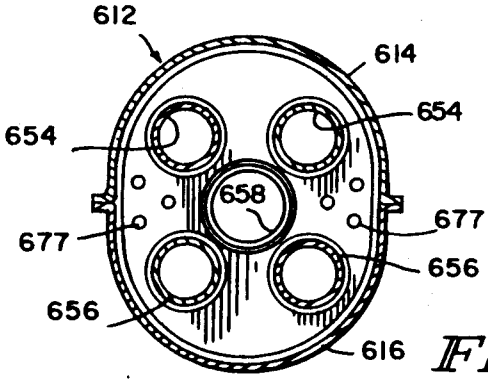
FIG. 12 is a transverse cross-sectional view of the exhaust processor assembly shown in FIG. 11, taken along lines 12—12 of FIG. 11.

A still further embodiment of the present invention is illustrated in FIGS. 11–12. Those numbers referenced by numbers identical to those used in FIGS. 1–10 perform the same or similar function. In this embodiment, an exhaust processor assembly 610 includes a housing 612 having a top shell 614 and a bottom shell 616 which cooperate to define a main flow passage through the housing 612. A partition 622 is located inside the housing 612 to divide the main flow passage into a first flow passage 628 and a second flow passage 630 inside the housing 612. The partition 622 is a three-dimensional, thin-walled, sheet metal stamping and is constructed to include an inlet cone section 623, a first body section 625, a transition section 627, and a second body section 629.

A main substrate 32 is situated inside the first flow passage 628 and an auxiliary substrate 634 is situated inside the second flow passage 630. A bypass valve 40 is used to direct flow of combustion product from the inlet 18 into the first flow passage 628 or the second flow passage 630. Main substrate 32 treats the combustion product passing through the first flow passage 628. During normal operation, flow of combustion product is directed into first flow passage 628. When the main substrate 32 becomes saturated or clogged and reaches a predetermined backpressure level, the bypass valve 40 switches to the dotted position shown in FIG. 11 to direct the flow of combustion product through the second flow passage 630. Main substrate 32 is then regenerated by a suitable burner (not shown) through burner inlet 642.

Combustion product passing through second flow passage 630 is filtered or treated by auxiliary substrate 634. Once the main substrate 32 is regenerated, bypass valve 40 returns to its original position to direct flow of combustion product through first flow passage 628. Auxiliary substrate 634 is then regenerated by a suitable burner (not shown) through burner inlet 644.

Muffler subassembly 650 inside housing 612 includes an upper pair of inlet tubes 654 located in close proximity to top half shell 614 and a lower pair of inlet tubes 656 located in close proximity to bottom half shell 616. A single outlet tube 658 permits the combustion extant in the muffler subassembly 650 to be exhausted through outlet 20. The cross-sectional arrangement of tubes 654, 656, and 658 inside housing 612 is illustrated in FIG. 12. A plurality of baffles 660, 662, 664 and 666 are used to secure upper inlet tubes 654, lower inlet tubes 656, and outlet tube 658 in a predetermined orientation inside the housing 612 between the top and bottom half shells 614 and 616. The baffles 660, 662, 664 and 666 are configured and located to define an expansion chamber 668, a first resonator chamber 670, and a second resonator chamber 672.

Partition 622 is axially spaced apart from muffler 650 to form a mixing region 652 between the downstream end of partition 622 and the upstream end of muffler 650. Combustion product exiting from either the first flow passage 628 or the second flow passage 630 is discharged into mixing region 652. Mixing region 652 is a substantially cylindrically shaped space bounded at its upstream end by the outlet face of substrate 634 and at its downstream end by baffle 660. Interior surfaces 635 and 637 of shells 614 and 616, respectively, cooperate to define the side boundary of mixing region 652. Combustion product discharged into mixing region 652 is able to enter muffler 650 through any of inlet tubes 654 or 656. Therefore, combustion product discharged from either first flow passage 628 or second flow passage 630 is exposed to the same muffler 650.

Once the combustion product enters the muffler 650, it is conducted into expansion chamber 668 via inlet tubes 654 and 656 and the apertures 655 and 657, respectively, formed therein without communicating with combustion product extant in second resonator chamber 672. The combustion product then enters outlet tube 658 via apertures 659 and is exhausted from the housing 612 though outlet 20. A portion of the combustion product passes the apertures 655 in inlet tubes 654 and enters resonator chamber 670 through openings 671 in upper inlet tubes 654, and another portion of the combustion product passes the apertures 657 in inlet tubes 656 and enters resonator chamber 670 through openings 673 in lower inlet tubes 656.

An additional portion of the combustion product enters resonator chamber 672 through opening 675 in outlet tube 658. Combustion production can pass from resonator chamber 670 into resonator chamber 672 through expansion chamber 668 via holes 677 in baffles 662 and 664 as shown in FIG. 12. The resonator chambers 670 and 672 further attenuate low frequency components of the combustion product.

Figure 13:
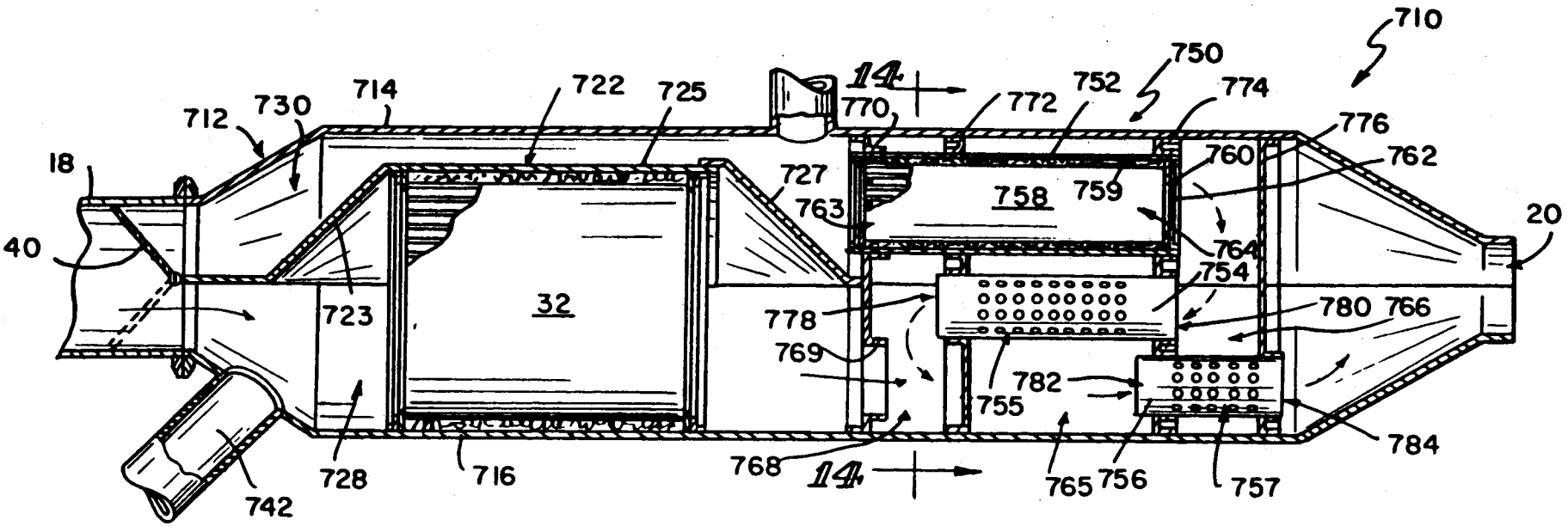
FIG. 13 is a sectional view of a seventh embodiment of the present invention, with portions broken away, showing a main substrate situated in a first flow passage of the housing, a muffler assembly situated in a downstream portion of the housing in close proximity to the outlet, and an auxiliary substrate situated in a second flow passage, the auxiliary substrate being positioned to extend into the muffler assembly and including an inlet end communicating with the second flow passage and an outlet and emptying into the muffler assembly.
Figure 14:
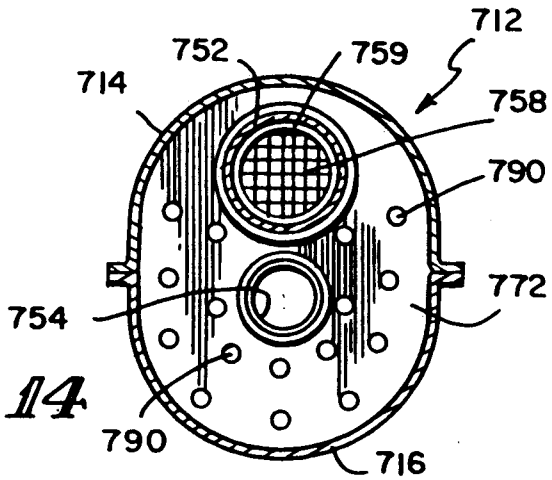
FIG. 14 is a transverse cross-sectional view of the exhaust processor assembly shown in FIG. 13, taken along lines 14—14 of FIG. 13.

An additional embodiment to the present invention is illustrated in FIGS. 13–14. Those numbers referenced by numbers identical to those used in FIGS. 1–12 perform the same or similar function. In this embodiment the exhaust processor assembly 710 includes a housing 712 having a top half shell 714 and a bottom half shell 716. A partition 722 is located inside the housing 712 to define a first flow passage 728 and a second flow passage 730 inside the housing 712. The partition 722 includes inlet cone section 723, body sections 725, and middle cone section 727.

During normal operation, valve 40 directs combustion product entering housing 712 through inlet 18 into the first flow passage 728 so that the combustion product passes through main substrate 32. When main substrate 32 becomes clogged and saturated with solid particles removed from the combustion product and the backpressure reaches a predetermined level, the valve 40 moves to the second valve position, shown in the dotted lines in FIG. 13, so that combustion product is diverted into the second flow passage 730 to bypass main substrate 32. Main substrate 32 is then regenerated by a suitable burner assembly (not shown) through burner inlet tube 742.

A muffler subassembly 750 extends between the top shell 714 and the bottom shell 716 between the main substrate 32 and the outlet 20. Muffler subassembly 750 includes an inlet tube 752, middle tube 754, and outlet tube 756. An auxiliary substrate 758 is situated inside inlet tube 752 to treat the combustion product passing through the second flow passage. The auxiliary substrate 758 is supported in its proper position inside inlet tube 752 by any conventional means such as mat 759. End seals 760 provide a seal between the substrate 32 and the wall of the inlet tube 752. Retaining rings 762 hold auxiliary substrate 758, mat 759, and end seals 760 in proper positions within the inlet tube 752. This arrangement ensures that all the combustion product passing through the second flow passage 730 will pass through auxiliary substrate 758 by creating an impenetrable seal between the substrate 758 and the inner wall of inlet tube 752.

Inlet end 763 of substrate 758 communicates with the second flow passage and an outlet end 764 of substrate 758 empties into first resonator chamber 766 of muffler 750. A plurality of baffles 770, 772, 774 and 776 are used to secure inlet tube 752, middle tube 754, and outlet tube 756 inside the housing 712 between the top and bottom half shells 714 and 716. The baffles 770, 772, 774, and 776 are configured and located to define expansion chamber 765, first resonator chamber 766, and second resonator chamber 768.

Combustion product exiting main substrate 32 in the first flow passage 728 enters second resonator chamber 768 through aperture 769 formed in baffle 770. The combustion product then passes through opening 778 in tube 754 and into expansion chamber 765 through apertures 755 in tube 754. Combustion product from expansion chamber 765 enters outlet tube 756 through opening 782 and passes through opening 784 in tube 756 to the outlet 20.

During regeneration of the main substrate 32, flow of combustion product passes through second flow passage 730, auxiliary trap 758, and into first resonator chamber 766. A portion of the combustion product from first resonator chamber 766 passes through apertures 757 in outlet tube 756 and through opening 784 to outlet 20. Another portion of the combustion product from first resonator chamber 766 passes to expansion chamber 765 through apertures 755 in tube 754. Combustion product from first resonator chamber 766 can pass through tube 754 to second resonator chamber 768. In addition, combustion product can pass from first resonator chamber 766 to second resonator chamber 768 through expansion chamber 765 via apertures 790 formed in baffles 772 and 774 as shown in FIG. 14. Resonator chambers 766 and 768 further attenuate low frequency components of the combustion product.

Although the invention has been described in detail with reference to certain preferred embodiments, variations and modifications exist within the scope and spirit of the invention as described and defined in the following claims.

What is claimed is:

1. An exhaust processor assembly comprising
a housing formed to include an inlet and an outlet,
partition means positioned within the housing for dividing an upstream portion of the housing into first and second flow passages,
a muffler situated in a downstream portion of the housing in close proximity to the outlet to attenuate noise generated by combustion product passing through one of the first and second flow passages toward the outlet,
a main filter substrate situated in the first flow passage to lie intermediate the inlet and the muffler and configured to collect particulate matter entrained in combustion product introduced into the first flow passage through the inlet, and
an auxiliary filter substrate situated in the second flow passage and configured to collect particulate matter entrained in the combustion product introduced into the second flow passage through the inlet.

2. The exhaust processor of claim 1, wherein the auxiliary filter substrate is positioned in the second flow passage to lie intermediate the inlet and muffler in spaced apart relation to the muffler.

3. The exhaust processor claim 1, wherein the auxiliary filter substrate is positioned to extend into the muffler and includes an inlet end communicating with the second flow passage and an outlet end emptying into the muffler.

4. The exhaust processor of claim 1, wherein the muffler includes at least three tubes and the auxiliary filter substrate is disposed in one of the at least three tubes.

5. The exhaust processor of claim 4, wherein the auxiliary filter substrate is positioned in a first tube having its inlet in direct communication with the second flow passage.

6. The exhaust processor of claim 4, wherein three tubes are aligned in series inside the muffler and the filter substrate is disposed in the first of the three tubes.

7. The exhaust processor of claim 1, wherein the housing includes a top shell and a bottom shell, the partition means includes a partition having a flange trapped between portions of the top and bottom shells to secure the partition in its position within the housing, the partition and the top shell cooperate to define the second flow passage therebetween, and the partition and the bottom shell cooperate to define the first flow passage therebetween.

8. The exhaust processor of claim 7, wherein the muffler extends between the top shell and the bottom shell to provide means for reversing the direction of combustion product flow in the housing to attenuate noise so that the noise generated by combustion product in the housing does not exceed a predetermined maximum magnitude.

9. The exhaust processor of claim 8, wherein the reversing means includes a plurality of baffles interconnecting the top shell and the bottom shell to define a plurality of chambers therebetween and at least two tubes configured and positioned to interconnect selected chambers to define means for conducting the combustion product through the muffler from each of the first and second flow passages toward the housing outlet.

10. An exhaust processor assembly comprising a housing formed to include inlet means for introducing combustion product into the housing, outlet means for exhausting the combustion product from the housing, and first and second flow passages communicating with the inlet means, first filtering means located in the first flow passage for filtering the combustion product as the combustion product passes through the first flow passage, means for selectively bypassing the first filtering means in the first flow passage to cause the combustion product introduced into the housing through the inlet means to be diverted from the first flow passage to the second flow passage inside the housing, second filtering means located in the second flow passage for filtering the combustion product as the combustion product passes through the second flow passage, and means for attenuating noise from the combustion product passing through one of the first and second flow passages, the attenuating means being positioned in the housing to communicate with the first and second flow passages and the outlet means and lie in close proximity to the outlet means.

11. The exhaust processor of claim 10, wherein the second filtering means is positioned in the second flow passage to lie intermediate the inlet and the attenuating means in spaced apart relation to the attenuating means.

12. An exhaust processor assembly comprising a housing formed to include inlet means for introducing combustion product into the housing, outlet means for exhausting the combustion product from the housing, and first and second flow passages communicating with the inlet means, first treating means located in the first flow passage for treating the combustion product as the combustion product passes through the first flow passage, means for selectively bypassing the first treating means in the first flow passage to cause the combustion product introduced into the housing through the inlet means to be diverted from the first flow passage to the second flow passage inside the housing, second treating means located in the second flow passage for treating the combustion product as the combustion product passes through the second flow passage, and means for attenuating noise from the combustion product passing through one of the first and second flow passages, the attenuating means being positioned in the housing to communicate with the first and second flow passages and the outlet means and lie in close proximity to the outlet means, wherein the second treating means is positioned, to extend into the attenuating means and includes an inlet end communicating with the second flow passage and an outlet end emptying into the attenuating means.

13. An exhaust processor assembly comprising a housing formed to include inlet means for introducing combustion product into the housing, outlet means for exhausting the combustion product from the housing, and first and second flow passages communicating with the inlet means, first treating means located in the first flow passage for treating the combustion product as the combustion product passes through the first flow passage, means for selectively bypassing the first treating means in the first flow passage to cause the combustion product introduced into the housing through the inlet means to be diverted from the first flow passage to the second flow passage inside the housing, second treating means located in the second flow passage for treating the combustion product as the combustion product passes through the second flow passage, and means for attenuating noise from the combustion product passing through one of the first and second flow passages, the attenuating means being positioned in the housing to communicate with the first and second flow passages and the outlet means and lie in close proximity to the outlet means, wherein the attenuating means includes a muffler having at least three tubes and the second treating means is disposed in one of the at least three tubes.

14. The exhaust processor of claim 13, wherein the second treating means is positioned in a first tube having its inlet in direct communication with the second flow passage.

15. The exhaust processor of claim 13, wherein three tubes are constructed in a series flow relationship and the second treating means is disposed in the first of the three tubes.

16. The exhaust processor of claim 10, wherein the housing is elongated and includes a top shell and a bottom shell, the bypassing means includes a partition having a flange trapped between portions of the top and bottom shells to secure the partition in its position within the housing, the partition cooperates with the top shell to define the second flow passage and with the bottom shell to define the first flow passage, the partition includes an inlet end positioned adjacent to the housing inlet and an outlet end positioned midway along the length of the elongated housing, the top and bottom shells cooperate to define a third flow passage therebetween interconnecting the first and second flow passages in the housing outlet, and the attenuating means is situated inside the third flow passage.

17. The exhaust processor of claim 16, wherein the attenuating means includes a plurality of baffles interconnecting the top and bottom shells to define a plurality of chambers in the third flow passage and a plurality of tubes arranged to extend through the baffles to define means for interconnecting selected chambers for communicating combustion product from the first and second flow passages to the housing outlet 18. An exhaust processor assembly comprising a housing including inlet means for introducing a combustion product into the housing and outlet means for exhausting combustion product from the housing, means for defining a first flow passage through a first portion of the housing, means for defining a second flow passage through a second portion of the housing, valve means for selectively directing the combustion product into either the first or the second flow passage, means located in the first flow passage for filtering combustion product passing through the first flow passage, means located in the second flow passage for filtering combustion product passing through the second flow passage, and means located in close proximity to the outlet means for attenuating noise from combustion product passing from the first or second flow passage toward the outlet means.

19. The assembly of claim 18, wherein the valve means includes a bypass valve to direct the combustion product into either the first or second flow passage, the attenuating means includes a muffler traversing the entire internal volume of the housing to attenuate noise generated by the combustion product directed through either the first or second flow passage by the bypass valve.

20. The assembly of claim 19, wherein the housing includes top and bottom clam shell portions, a partition situated in a predetermined position inside the housing, the partition cooperating with the bottom clam shell and the top clam shell to form the first and second flow passages, respectively, a muffler extending between the top and bottom clam shells to provide means for reversing the direction of combustion product in the housing to attenuate noise so that noise generated by combustion product in the housing does not exceed a predetermined maximum magnitude.

21. The assembly of claim 20, wherein the reversing means include a plurality of baffles interconnecting the top clam shell to define a plurality of muffler chambers therebetween and at least two tubes configured and positioned to interconnect selected chambers to define means for conducting combustion product through the muffler toward the housing outlet.

22. An exhaust processor assembly comprising a housing including inlet means for introducing a combustion product from an engine into the housing and outlet means for exhausting the combustion product from the housing, means traversing an inner region of the housing in close proximity to the outlet, means for acoustically tuning the combustion product passing through the housing, means for dividing an upstream portion of the inner region of the housing into a first flow passage and a second flow passage, each flow passage providing communication between the inlet means and the tuning means, first means located in the first flow passage for filtering the combustion product passing through the first flow passage, and second means located in the second flow passage for filtering combustion product passing through the second flow passage.

23. The assembly of claim 22, wherein the dividing means includes a partition positioned inside the housing, the partition cooperating with an inner wall of the housing to define the first and second flow passages.

24. The assembly of claim 22, wherein the tuning means includes a muffler subassembly traversing the inner region of the housing, the muffler subassembly having at least one inlet tube, at least one outlet tube, means for providing at least one expansion chamber, and means for providing at least one resonator chamber for acoustically tuning the combustion product passing through the housing.

25. An exhaust processor assembly comprising a housing including inlet means for introducing a combustion product into the housing and outlet means for exhausting combustion product from the housing, a muffler assembly situated in the downstream portion of the housing in close proximity to the outlet means to attenuate noise generated by combustion product passing through the housing toward the outlet, a partition positioned inside the housing for defining first and second flow passages extending between the inlet and the muffler assembly, a main substrate situated in the first flow passage and configured to collect particulate matter entrained in the combustion product introduced into the first flow passage through the inlet means, means for selectively bypassing the main substrate in the first flow passage to cause the combustion product introduced into the housing through the inlet means to be diverted from the first flow passage to the, second flow passage, and an auxiliary substrate situated inside the muffler assembly and configured to collect particulate matter entrained in the combustion product entering the muffler assembly from the second flow passage.

26. The assembly of claim 25, wherein the muffler assembly traverses the entire inner volume of the housing and the muffler assembly includes means for providing at least one expansion chamber and means for providing at least one resonator chamber for acoustically tuning the combustion product.

27. The assembly of claim 26, wherein the muffler assembly includes a plurality of baffles configured to define a first resonator chamber and a second resonator chamber, the auxiliary substrate extends between the second flow passage and the first resonator chamber to provide communication therebetween, and the second resonator chamber is formed to receive combustion product passing through the main substrate through the first flow passage.

28. An exhaust processor assembly comprising a housing assembly formed to include an inlet and an outlet, means situated in the housing assembly in close proximity to the outlet for attenuating noise generated by combustion product passing through the housing assembly, means for dividing a portion of the housing in close proximity to the inlet into first and second flow passages, first means located in the first flow passage for filtering combustion product passing through the first flow passage toward the outlet, second means located in the second flow passage for filtering combustion product passing through the second flow passage toward the outlet, valve means for selectively directing combustion product entering the housing through the inlet into either the first or second flow passage, and a mixing region formed between the attenuating means and dividing means to permit combustion product passing through either the first or second flow passage to mix before entering the attenuating means.

29. The processor of claim 28, wherein the attenuating means includes a plurality of baffles defining a plurality of muffler chambers in the housing and a plurality of tubes arranged to extend through the baffles to define means for interconnecting selected muffler chambers for communicating combustion product from the first and second flow passages to the housing outlet.

30. The exhaust processor of claim 29, wherein the dividing means includes a partition positioned in a predetermined location inside the housing assembly and the partition cooperates with an inner wall of the housing to define the first and second flow passages.

* * * * *